US005664629A

United States Patent [19]

Maitland

[11] Patent Number: 5,664,629

[45] Date of Patent: Sep. 9, 1997

[54] DOWN-HOLE TOOLS

[75] Inventor: George Maitland, Laurencekirk, Great Britain

[73] Assignee: Petroleum Engineering Services Limited, Dyce, Great Britain

[21] Appl. No.: 443,526

[22] Filed: May 18, 1995

[30] Foreign Application Priority Data

May 19, 1994 [GB] United Kingdom ..... 9410012

[51] Int. Cl.[6] ..... E21B 34/10

[52] U.S. Cl. ..... 166/373; 166/321

[58] Field of Search ..... 166/321, 323, 166/324, 373, 191

[56] References Cited

U.S. PATENT DOCUMENTS

| | | | |
|---|---|---|---|
| 3,794,112 | 2/1974 | Hill | 166/64 |
| 4,083,409 | 4/1978 | Barrington | 166/320 |
| 4,448,254 | 5/1984 | Barrington | 166/373 |
| 4,617,999 | 10/1986 | Beck | 166/372 |
| 4,646,838 | 3/1987 | Manke | 166/321 |
| 4,691,779 | 9/1987 | McMahan et al. | 166/321 |
| 4,770,246 | 9/1988 | Ward | 166/297 |
| 5,050,681 | 9/1991 | Skinner | 166/374 |
| 5,058,673 | 10/1991 | Muller et al. | 166/187 |
| 5,180,007 | 1/1993 | Manke et al. | 166/321 |
| 5,209,303 | 5/1993 | Barrington | 166/374 |
| 5,518,073 | 5/1996 | Manke et al. | 166/321 X |

FOREIGN PATENT DOCUMENTS

| | | |
|---|---|---|
| 0 092 341 | 10/1983 | European Pat. Off. . |
| 0 482 926 | 4/1992 | European Pat. Off. . |
| 2 048 982 | 12/1980 | United Kingdom . |

*Primary Examiner*—Frank Tsay
*Attorney, Agent, or Firm*—Kenyon & Kenyon

[57] ABSTRACT

A time delay mechanism wherein there is provided a time delay between the application of a pressure to the mechanism and an action being carried out as a result of the application of said pressure. The mechanism may comprise a first piston and piston chamber and a second piston and piston chamber. Communication of a viscous fluid between said piston chambers may be achieved by means of at least one contoured flow passage.

20 Claims, 1 Drawing Sheet

DOWN-HOLE TOOLS

BACKGROUND OF THE INVENTION

This invention relates to down-hole tools, and in particular, though not exclusively, to a time delay mechanism for use with down-hole tools.

Down-hole pressure actuated or initiated devices which may be, for example, suspended from "pack-off" devices tubing or casing well conduit are known, per se. Typical "pack-off" devices include bridge plugs such as GB 2 261 895 B (Petroleum Engineering Services Limited), incorporated herein by reference.

Known cyclic/shear devices suffer from a number of problem. For example, maximum pressure application from above is normally limited with known devices. Furthermore, a well conduit may be provided with a number of pressure actuated or initiated devices throughout its entirety problems exist in testing one or more of these devices without accidentally activating another.

SUMMARY OF THE INVENTION

It is an object of the present invention to obviate or mitigate the aforementioned disadvantages in the prior art.

According to a first aspect of the present invention, there is provided a time delay device for use with a down-hole tool comprising a first chamber communicable with a second chamber via at least one orifice (restrictor) and means for controllable transporting a fluid from said first chamber to said second chamber.

In a preferred embodiment the transport means comprises a first piston.

Further said second chamber may provide a second piston.

The second piston may be movable via applied pressure from a first position to a second position under the influence of movement of the first piston against the influence of biasing means within the second chamber.

The first and/or second chamber may be filled with a fluid such as silicone.

A one-way check valve may so be provided between the second chamber and the first chamber to allow fluid to flow from the second chamber to the first chamber.

The at least one restrictor between the first and second chambers may take the form of a Lee visco jet or other suitable contoured flow passage.

The flow rate of fluid through the at least one restrictor, and hence the time delay between the application of pressure to the first piston and the action of the second piston, may be varied by changing the flow characteristics of the at least one restrictor.

According to a second aspect of the present invention, there is provided a down-hole tool including a time delay mechanism comprising a first chamber communicable with a second chamber via at least one orifice (restrictor) and means for controllably transporting a fluid from said first chamber to said second chamber.

According to a third aspect of the present invention, there is provided a method of providing a time delay between the application of pressure and an action being carried out as a result of said application of pressure by providing a pressure responsive time delay device comprising a first chamber communicable with a second chamber via at least one orifice and means for controllably transporting a fluid from said first chamber to said second chamber.

According to a fourth aspect of the present invention, there is provided a down-hole pressure equalizing device comprising a body having at least one closing port and openable means for closing the at least one port wherein, in use, the closure means are controllably opened by means of a time delay mechanism.

According to a preferred embodiment, the time delay mechanism comprises a first piston and first piston chamber, the first piston chamber begin communicable with a second piston and piston chamber via at least one restrictor.

The second piston may be movable from a first position to a second position under the influence of movement of the first piston against the influence of biasing means within the second chamber.

Movement of the second piston to the second position may allow the closure means to open thereby equalizing pressure across the device.

The first and/or second chamber may be filled with a fluid such silicone.

The at least one restrictor may take the form of a Lee visco jet or may other suitably contoured flow passage.

The device may have connection means provided at or near an uppermost portion thereof for suspending the device from another device.

The body may be a cylindrical housing having a plurality of ports spaced around the circumference thereof, and the openable closure means may be a mandrel within the housing moveable therealong.

A one-way valve may also be provided between the second chamber and the first chamber to allow fluid flow from the second to the first chamber.

According to a fifth aspect of the present invention there is provided a method of controlling pressure down-hole by providing a down-hole pressure equalizing device comprising a body having at least one port and openable means for closing the at least one port the method comprising controllably opening the closure means by means of a time delay mechanism.

DETAILED DESCRIPTION

Figure 1:
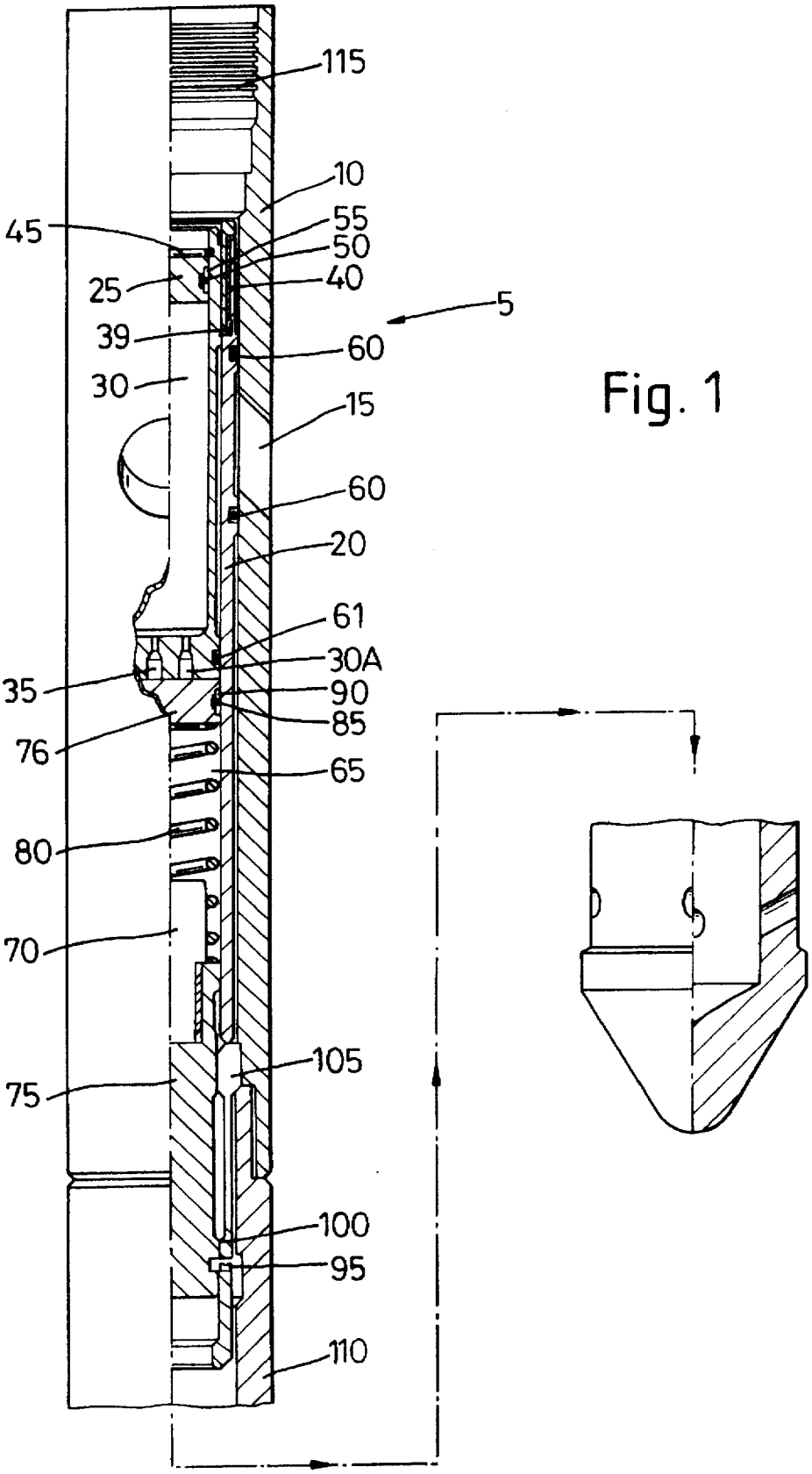
FIG. 1 is a partial cross-sectional side view of a down-hole pressure equalizing device incorporating a time delay mechanism according to one embodiment of the present invention.

An embodiment of the invention will now be described by way of example only with reference to the drawing.

Referring to the drawing, there is illustrated a down-hole pressure equalizing device, generally designated 5. The device 5 comprises a body in the form of an outer cylindrical housing 10 having a plurality of ports 15 provided around the circumference thereof. Within the housing 10 there is provided openable closure means for closing the at least one port comprising a latch mandrel 20. The closure means are controllably openable by means of a time delay mechanism which will now be described.

The time delay mechanism comprises a first piston 25 which is packed with silicone or other suitable viscous fluid and movably provided within a first piston chamber 30 which houses a restrictor 35. The restrictor in this embodiment is in the form of a Lee visco jet.

A shear ring 39 and shear ring retainer 40 are provided at a first end of the latch mandrel 20 between the mandrel 20 and the first chamber 30. Further a snap ring 45 is provided at a first end of the first chamber to restrict movement of the first piston 25. A T-seal 50 and T-seal back-up 55 are provided on an outer edge of the first piston 25 so as to provide a fluid-tight seal between the first piston 25 and an inner wall of the first chamber 30.

The device 5 as illustrated in FIG. 1 is shown in a closed position. As can be seen from FIG. 1, in the closed position, a pair of O-rings 60 provided on an outer surface of the mandrel 20 are located on either side of each port 15 so as to seal the ports 15.

The chamber 30 also houses a one-way check valve 30A which prevents flow out of the first chamber 30 but allows flow into the first chamber 30.

A further O-ring 61 is provided at an end of the first chamber 30 to provide a fluid-tight seal between the first chamber 30 and the mandrel 20.

The first chamber 30 communicates with a second piston chamber 65 via the restrictor 35. The second chamber 65 is formed from adjacent walls of a piston stop member 70, a collet support 75, the mandrel 20 and the first chamber 30. Provided within the second chamber 65 is a second piston 76 which is biased towards the first chamber by a coil spring 80. A T-seal 85 and T-seal back-up 90 are provided on an outer edge of the second piston 76 so as to provide a fluid-tight seal between the second piston 76 and an inner wall of the mandrel 76.

As seen from FIG. 1, in the closed position, the collet support 75 is connected via shear screws 95 to a collet 100 having collet fingers 105. The collet 100 is retained within a cylindrical body 110 having a snub nose.

Within the first and second chambers 30, 65, there is packed a substantially incompressible fluid material, e.g., silicone.

In use, pressure applied above the device 5 acts on the first piston 25 contained within the first chamber 30. The silicone packed in the first chamber 30 is displaced into the second chamber 65 via the restrictor 35. The displaced silicone acts on the second piston 76 and against spring 80. The time delay created by the restrictor 35 limits the stroke of the second piston 76 allowing pressure to be maintained above the device 5 for a pre-determined period of time. The restrictor 35 size and silicone viscosity dictate the specific time delay.

If the second piston 76 is allowed to contact the collet support 75 applied load is then transferred through the shear screws 95 which hold the collet 100 and collet support 75 together and can cause screws 95 to sheer. Sheering of the screws 95 permits downward travel of the collet support 75 thus de-supporting the collet 100 and allow travel of the mandrel 20. Communication from one end of the device 5 to the other is then accomplished.

It should be appreciated that if pressure applied above the device 5 is limited to a time period frame that does not permit a full stroke of the second piston 76, the spring 80, once pressure is bled off, will return the second piston 76 to its original position as shown in FIG 1. Displacement of the silicone back to the first chamber 30 is accomplished via the one-way "quick dump" check valve 30A housed in the first chamber 30.

It should also he appreciated that in the unlikely event of the primary actuation mode malfunctioning, the device 5 may be mechanically activated.

Referring to FIG. 1, the embodiment illustrated therein provides connection means, e.g., an internally threaded portion 115 by which the device 5 my be connected to a "pack-off" device (not shown).

The embodiment of the invention hereinbefore described is given by way of example only, and is not meant to limit the scope of the invention in any way. It should particularly be appreciated that the one-shot time delay ("TD") equalizing device 5 described hereinbefore is a tool that, when suspended from a "pack-off" device in a tubing or casing well conduit, provides for multiple pressure cycling from above. Only when pressure has been applied for a predetermined time period will the equalization mechanism actuate. Thus, erroneous actuation is sought to be avoided. The time delay feature facilitates maximum pressure application from above that is normally limited with traditional cycle/equalizing device.

The device described hereinbefore is but one example of a down-hole tool employing the present invention. Other examples of uses of the time delay mechanism include utilization as a safety barrier to a pressure sensitive timer switch on a down-hole pyrotechnic setting tool, as a barrier to a pressure sensitive activation device for initiating the openning of a hydrostatic setting tool, or as a damper against unexpected pressure surges which could adversely affect the operation of pressure sensitive equipment.

What is claimed is:

1. A time delay device for use with a down-hole tool, the time delay device comprising:

a first chamber communicable with a second chamber via at least one restrictor;

means for controllably transporting a fluid from said first chamber to said second chamber; and a one-way check valve provided between the first chamber and the second chamber, wherein the one-way check valve allows fluid to flow from the second chamber to the first chamber at a flow rate greater than the flow rate of the fluid through the at least one restrictor.

2. The time delay device of claim 1, wherein the transport means comprises a first piston.

3. The time delay device of claim 2, wherein said second chamber provides a second piston.

4. The time delay mechanism of claim 3, wherein the second piston is movable via applied pressure from a first position to a second position under the influence of movement of the first piston against the influence of biasing means within the second chamber.

5. The time delay mechanism of claim 3, wherein the at least one restrictor between the first and second chambers is a Lee visco jet.

6. The time delay mechanism of claim 3, wherein the flow rate of fluid through the at least one restrictor, and hence the time delay between the application of pressure to the first piston and action of the second piston, may be varied by changing the flow characteristics of the at least one restrictor.

7. The time delay mechanism of claim 1, wherein the first and second chambers are filled with a fluid.

8. The time delay mechanism of claim 7, wherein the fluid is silicone.

9. A down-hole tool including a time delay device, the time delay device comprising:

a first chamber communicable with a second chamber via at least one restrictor;

means for controllably transporting a fluid from said first chamber to said second chamber; and a one-way check valve provided between the first chamber and the second chamber, wherein the one-way check valve allows fluid to flow from the second chamber to the first chamber at a flow rate greater than the flow rate of the fluid through the at least one restrictor.

10. A method of providing a time delay for a down-hole tool between the application of pressure and an action being carried out as a result of said application of pressure, comprising the steps of:

providing a first chamber having a fluid;

providing a second chamber communicable with said first chamber via at least one orifice;

controllably transporting said fluid from said first chamber through said at least one orifice to said second chamber in response to pressure applied to the down-hole tool; and providing a one-way check valve between the first chamber and the second chamber to allow fluid to flow from the second chamber to the first chamber at a flow rate greater than the flow rate of the fluid through the at least one orifice.

11. A down-hole pressure equalizing device comprising a body having at least one closing port and openable closure means for closing the at least one port wherein, in use, the openable closure means are controllably opened by means of a time delay mechanism, the time delay mechanism comprising a first chamber communicable with a second chamber via at least one restrictor and means for controllably transporting a fluid from the first chamber to the second chamber, wherein a one-way check valve is provided between the second chamber and the first chamber to allow fluid to flow from the second chamber to the first chamber at a flow rate greater than the flow rate of the fluid through the at least one restrictor.

12. The device of claim 11, wherein the time delay mechanism comprises a first piston and a first piston chamber, the first piston chamber being communicable with a second piston and a second piston chamber via at least one restrictor.

13. The device of claim 12, wherein the second piston is movable from a first position to a second position under the influence of movement of the first piston against the influence of biasing means within the second chamber.

14. The device of claim 13, wherein movement of the second piston to the second position allows the openable closure means to open, thereby equalizing pressure across the device.

15. The device of claim 12, wherein the first and second piston chambers are filled with a fluid.

16. The device of claim 15, wherein the fluid is silicone.

17. The device of claim 12, wherein a one-way valve is provided between the second chamber and the first chamber to allow fluid flow from the second chamber to the first chamber.

18. The device of claim 11, wherein the device has connection means provided at or near an uppermost portion thereof for suspending the device from another device.

19. The device of claim 11, wherein the body is a cylindrical housing having a plurality of ports spaced around the circumference thereof, and the openable closure means is a mandrel within the housing moveable therealong.

20. A method of controlling pressure down-hole by providing a down-hole pressure equalizing device comprising a body having at least one port and openable closure means for closing the at least one port, the method comprising controllably opening the openable closure means by means of a time delay mechanism, the time delay mechanism comprising a first chamber communicable with a second chamber via at least one restrictor and means for controllably transporting a fluid from the first chamber to the second chamber, wherein a one-way check valve is provided between the second chamber and the first chamber to allow fluid to flow from the second chamber to the first chamber at a flow rate greater than the flow rate through the at least one restrictor.

* * * * *